United States Patent [19]

Kunzler

[11] Patent Number: 4,663,802

[45] Date of Patent: May 12, 1987

[54] GRIPPING HANDLE FOR AN ATTACHE CASE HAVING A PIVOT PIN ON ONLY ONE OF ITS LEG EXTENSIONS

[76] Inventor: Herold Kunzler, Rostrainstrasse #12, 8915 Hausen a.A., Switzerland

[21] Appl. No.: 853,141

[22] Filed: Apr. 17, 1986

Related U.S. Application Data

[63] Continuation of Ser. No. 707,797, Mar. 4, 1985, abandoned.

[51] Int. Cl.[4] ..... B25G 3/28

[52] U.S. Cl. ..... 16/124; 16/126; 16/259; 16/DIG. 24

[58] Field of Search ..... 16/114 R, 124, 126, 16/257, 259, DIG. 13, DIG. 24, 260, 261, 270; 190/39, 115, 116

[56] References Cited

U.S. PATENT DOCUMENTS

| | | | |
|---|---|---|---|
| 2,305,562 | 12/1942 | Thompson et al. | 16/257 X |
| 3,021,883 | 2/1962 | Kanner et al. | 190/115 |
| 3,952,232 | 4/1976 | Coules | 16/114 R X |
| 4,323,807 | 4/1982 | Sugiura | 16/DIG. 13 X |
| 4,383,488 | 5/1983 | Macho et al. | 16/DIG. 13 X |

FOREIGN PATENT DOCUMENTS

| | | | |
|---|---|---|---|
| 2711898 | 8/1978 | Fed. Rep. of Germany | 16/126 |

*Primary Examiner*—Fred Silverberg
*Attorney, Agent, or Firm*—Bauer & Amer

[57] ABSTRACT

A handle having a pair of legs each bifurcated at its end to provide a slot defined by a pair of fingers. One of the fingers is flexible and is provided with a cylindrical pin, the end of which has an inclined cam surface forming a slide on which an eyelet hinge bracket rides when inserted into the slot. The flexible finger moves permitting easy entry of the lug.

1 Claim, 5 Drawing Figures

GRIPPING HANDLE FOR AN ATTACHE CASE HAVING A PIVOT PIN ON ONLY ONE OF ITS LEG EXTENSIONS

This is a continuation of application Ser. No. 707,797, filed Mar. 4, 1985, now abandoned.

BACKGROUND OF THE INVENTION

The present invention relates to a handle construction for an attache case or the like.

It is the principle object of the present invention to provide a handle for carrying an attache case, travel luggage or the like which is simple in construction, economical to manufacture and easily and quickly assembled on the case without requiring the use of any tools.

It is another object of the present invention to provide a handle and a separate hinge bracket, both of which may be readily formed of interfittable shape, preferably by molding which may be readily snapped into interfitted operative relation with each other.

Still another object of the present invention is to provide a handle and hinge bracket of the above character whose constructions is such that the parts may be readily molded of inexpensive plastic construction material.

These objects, together with other objects and advantages will be apparent from the following disclosure.

SUMMARY OF THE INVENTION

According to the present invention, the handle is generally U-shaped, having a connecting leg and a pair of opposed side legs. Each of the side legs terminates in a bifurcated extension having a pair of opposed fingers defining a compartment therebetween. The lug of a hinge bracket provided with a circular eye, is attached to the wall of the attache case or the like. The circular eye is inserted within the compartment and held by the fingers of the bifurcated extension. One finger of each of the bifurcated extension has a laterally inwardly directed cylindrical pivot pin which fits into the eye opening in the lug of the hinge bracket. The cylindrical pivot pin is formed with an inclined surface serving as a cam so that on insertion of the lug into the compartment defined by the fingers of the bifurcated extension, the finger on which the pivot pin is formed is caused to resiliently distend and flex allowing the lug to enter fully into the compartment until the pivot pin seats within the opening of the hinge bracket. Thereafter, the flexed finger returns to its normal position securing the handle to the hinge bracket and allowing the handle to pivot or swing about the axis of the projecting pivot pins.

Full details of the present invention are set forth in the following disclosure and are illustrated in the accompanying drawings.

DESCRIPTION OF THE INVENTION

Figure 1:
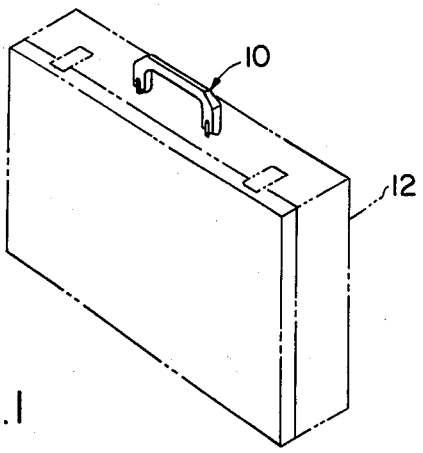
FIG. 1 is an isometric view of the handle and hinge bracket of the present invention in place on an attache case.

The handle of the present invention, generally depicted by the numeral 10 is shown in FIG. 1 as being applied to an attache case 12 although it may be easily applied to other types of luggage or bags as desired.

The handle 10 is attached to the case 12 by a pair of hinge brackets 14 which have a button-like head 16 and a flat eyelet lug 18 extending perpendicularly from the inner face of the head. The hinge brackets 14 are secured to the case by passing the lug through a slot 20 formed in the wall of the case and by fixing the head 16 by conventional means such as by riveting, bolting or by welding the head to the undersurface of the wall. The lug 14 of the hinge bracket has a rounded edge 24 and a circular opening 26.

The handle 10 is a U-shaped member comprising a central connecting leg 28 and a pair of extending parallel side legs 30 each terminating in a bifurcated extension 32 forming a pair of opposing members **34*a* and 34*b* defining a compartment 36 therebetween running perpendicular to the direction of the central leg 28 of the handle. The outer finger 34*a* of each of the bifurcated extensions 32 is provided with a pivot pin 38 projecting inwardly along a common axis extending parallel to the central leg 28 of the handle. The width of the compartment between the two fingers of each bifurcation conforms to the thickness of the lug 18 of the hinge bracket while the diameter of the pivot pin 38 conforms to the diameter of the opening 26. Consequently, when the lugs 18 are inserted into the compartment 36** between the fingers of the bifurcations, the handle can, with very little exertion, be made to swing about the axis of the pivot pins to either side.

Figure 2:
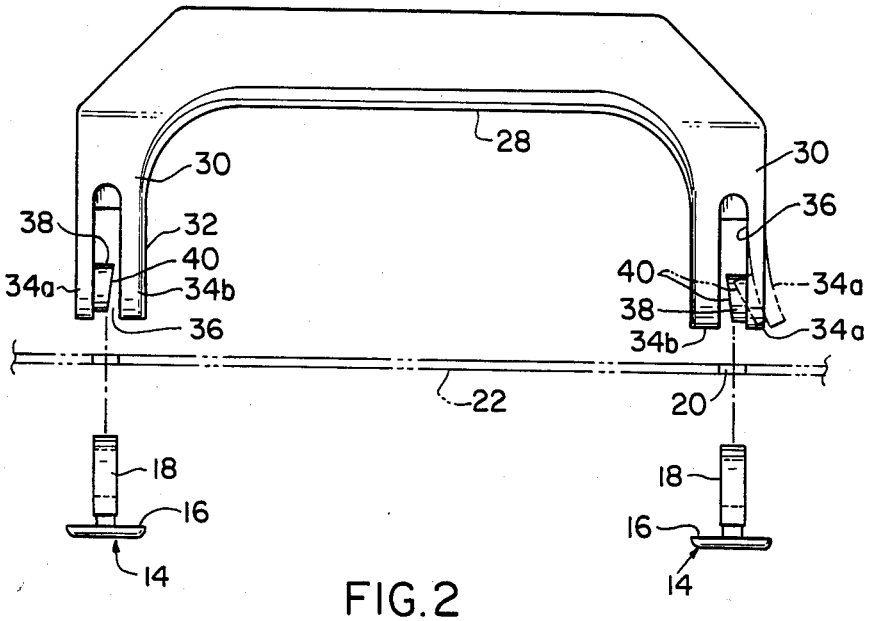
FIG. 2 is a front view showing the parts of the present invention in a spaced relationship with regard to the wall of the attache case.
Figure 3:
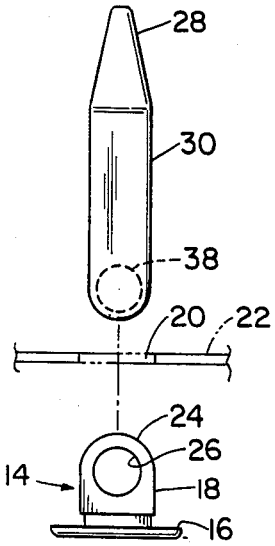
FIG. 3 is an end view of the arrangement shown in FIG. 2.
Figure 4:
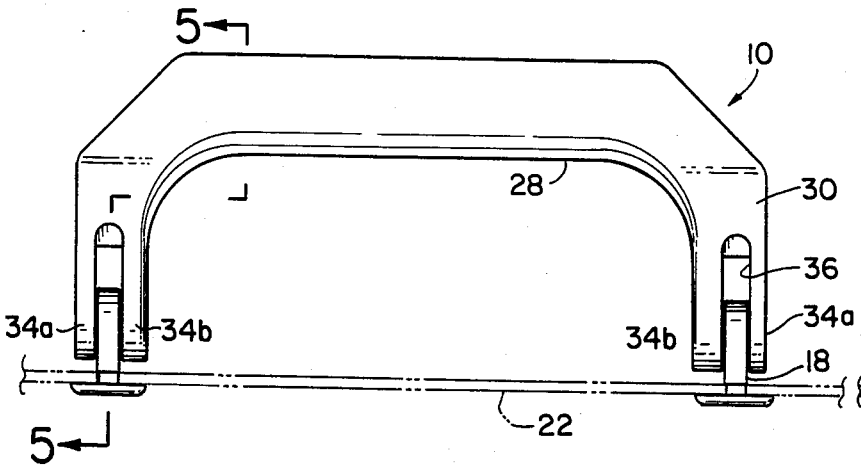
FIG. 4 is a front elevational view showing the handle and hinge bracket assembled.
Figure 5:
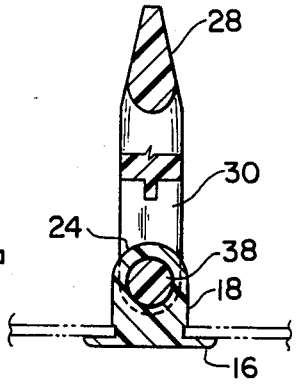
FIG. 5 is a sectional view taken along line 5—5 of FIG. 4.

The pivot pins 38 are integrally formed with the respective fingers **34*a* to which they are attached so as to be secured thereto. As seen in FIG. 2, each pivot pin 38 is cylindrical and has its inward end tapered to have an inclined surface 40 which is spaced from the inside finger of its respective bifurcation. The pivot pins have the smallest axial direction adjacent the opening in the slot 36 so as to form a cam surface permitting the lug 18 of the hinge bracket to enter easily into the slot 36 and ride on the inclined surface 40 causing the exterior finger 34*a* of each bifurcation to resiliently flex or extend in an outward direction as indicated by the dot-dash lines shown in FIG. 2. In this manner, the handle is easily attachable to the hinge bracket simply by pressing the handle onto the hinge lug 18 until the pivot pin 38 seats firmly within the hole 26**. Thereafter, the exterior finger of the bifurcation will snap back into its original position securely holding the handle to the hinge bracket.

Preferably, the handle is made of polyethylene or similar slightly resilient plastic material which has a high degree of memory and retention in its original position and which is not easily distorted by temperature changes or excessive use. There does not appear to be any critical limit to the size or proportions of the handle or hinge bracket except that the length of the fingers in each bifurcation should be maintained so that just that degree of resiliency or felxibility is obtained, with the specific material used, to permit insertion of the lug therein. To facilitate flexibility, the outer finger 34*a* may be slightly thinner than the inner finger 34*b*.

As will be seen from the foregoing, a simple and effective way of forming a handle and hinge is disclosed by the present invention. The handle and hinge can be made extremely economically, of relatively inexpensive materials and will be effective and secure for both pivotal and the carrying forces over an extended period of life.

Various changes and modifications have been suggested and other changes will be apparent to those skilled in the present art. Accordingly, it is intended that the present disclosure is taken as illustrative and not limiting of the invention.

What is claimed:

1. A gripping handle for an attache case comprising opposite side legs of resilient plastic construction material and a connecting leg forming a U-shaped body, each said resilient plastic side leg terminating in resilient plastic bifurcated extensions bounding a compartment therebetween, a pair of hinges, each hinge having a horizontally oriented cylindrical opening therethrough for receiving in projected relation therein a hinge pin, only one of each pair of the resilient plastic bifurcated extensions having a cylindrical projection thereon extending laterally from said extension and terminating in an end located in a clearance position from said other extension so as to serve as the hinge pin extending into said compartment at a location selected to align with said opening of said hinge, said end of said laterally extending projection having an inclined surface throughout its entirety serving as a cam so as to cause displacement of said resilient plastic bifurcated extension from an original position to a lateral position during the insertion of said hinge into said compartment and the movement of said inclined surface of said projection along said hinge, whereby said projection serving as said hinge pin is urged into said hinge cylindrical opening by the resiliency of said plastic construction material of said bifurcated extension causing movement of said extension to its said original position to complete the hinged connection of said gripping handle to the hinges of said attache case, said cylindrical projection having a first outside diameter and said cylindrical opening having a second inside diameter, said first diameter being substantially the same as the second diameter.

* * * * *